US007765736B1

(12) United States Patent
Lloyd

(10) Patent No.: US 7,765,736 B1
(45) Date of Patent: Aug. 3, 2010

(54) SELF-WATERING, VERTICALLY ADJUSTABLE TREE STAND AND ASSOCIATED METHOD

(76) Inventor: Daniel P. Lloyd, 45 SW. Eagle Crest Dr. #320, Lake Oswego, OR (US) 97035

( * ) Notice: Subject to any disclaimer, the term of this patent is extended or adjusted under 35 U.S.C. 154(b) by 600 days.

(21) Appl. No.: 11/598,517

(22) Filed: Nov. 13, 2006

(51) Int. Cl.
*A47G 33/12* (2006.01)

(52) U.S. Cl. ..... 47/40.5; 47/42; 47/48.5

(58) Field of Classification Search ..... 47/40.5, 47/29.5, 65, 39, 48.5, 42, 43; 248/125.8, 248/519, 523, 527; 211/82.23, 102, 103
See application file for complete search history.

(56) References Cited

U.S. PATENT DOCUMENTS

| | | | | | |
|---|---|---|---|---|---|
| 351,669 | A | * | 10/1886 | Tosso | 248/515 |
| 2,938,304 | A | * | 5/1960 | Orrin et al. | 47/57.5 |
| 3,185,416 | A | * | 5/1965 | Osinski | 248/527 |
| 3,484,067 | A | * | 12/1969 | Fulper | 47/40.5 |
| 3,874,344 | A | * | 4/1975 | Smith | 119/78 |
| 4,133,345 | A | * | 1/1979 | Mitchell | 137/446 |
| 4,254,794 | A | * | 3/1981 | Smith | 137/434 |
| 4,329,940 | A | * | 5/1982 | Humphries | 119/72 |
| 5,161,768 | A | * | 11/1992 | Sarabin | 248/525 |
| D349,259 | S | | 8/1994 | Adam | |
| 5,362,024 | A | * | 11/1994 | Grinnen | 248/524 |
| 5,375,807 | A | * | 12/1994 | Claas | 248/514 |
| 5,439,196 | A | * | 8/1995 | Widman | 248/524 |
| 5,446,993 | A | | 9/1995 | Cullen | |
| 5,522,179 | A | | 6/1996 | Hollis | |
| 5,575,110 | A | | 11/1996 | Couture | |
| 5,699,634 | A | * | 12/1997 | Erdahl | 47/40.5 |
| 5,791,082 | A | * | 8/1998 | Finello | 47/40.5 |
| 5,791,083 | A | | 8/1998 | Giangrossi | |
| 5,835,018 | A | * | 11/1998 | Kursel et al. | 340/620 |
| 5,867,929 | A | * | 2/1999 | Jung et al. | 47/40.5 |
| 5,937,574 | A | * | 8/1999 | Jacques | 47/40.5 |
| 5,938,168 | A | * | 8/1999 | Adams | 248/523 |
| D451,839 | S | | 12/2001 | Pomeroy et al. | |
| 6,382,582 | B1 | | 5/2002 | Brown | |

(Continued)

FOREIGN PATENT DOCUMENTS

DE 4142623 A1 * 6/1993

(Continued)

*Primary Examiner*—David J Parsley
*Assistant Examiner*—Danielle Clerkley
(74) *Attorney, Agent, or Firm*—Montgomery Patent and Design; Robert C. Montgomery; Joseph T. Yaksich

(57) ABSTRACT

The invention as presently conceived discloses a unique system and method that incorporates a self-watering tree stand that is an improvement on a conventional floor-standing holiday tree stand and watering system. The design of this novel tree stand is that it supports the tree from the tree's midsection that allows gravity to self-level the tree held within the stand. The stand comprises a large circular base for stability as well as adjustable height watering cup that can be brought up to the bottom of the tree and is fed from a water reservoir located on the vertical section of the stand at the outside perimeter of the tree. Also integral to the system and apparatus is a power receptacle fed from a power cord located near the top of the stand in order to power decorative lights or other electric tree decorations.

8 Claims, 9 Drawing Sheets

U.S. PATENT DOCUMENTS

| | | | | |
|---|---|---|---|---|
| 6,457,683 | B1 * | 10/2002 | Armstrong, Sr. | 248/122.1 |
| 6,581,890 | B2 * | 6/2003 | Johnson et al. | 248/161 |
| 6,966,334 | B2 | 11/2005 | Bolster | |
| 2004/0065007 | A1 * | 4/2004 | Manell | 47/40.5 |

FOREIGN PATENT DOCUMENTS

| | | | |
|---|---|---|---|
| DE | 19858179 | A1 * | 4/2000 |

* cited by examiner

SELF-WATERING, VERTICALLY ADJUSTABLE TREE STAND AND ASSOCIATED METHOD

RELATED APPLICATIONS

The present invention was first described in Disclosure Document No. 595,156 filed on Feb. 16, 2006.

FIELD OF THE INVENTION

This invention relates to tree stands and, more particularly, to a combined tree supporting and watering stand for maintaining a tree at a vertical position while supplying a predetermined quantity of water to the tree.

BACKGROUND OF THE INVENTION

The holiday season is a time of great fun and happiness for everyone. A great deal of the holiday cheer comes from the yearly traditions that are passed from generation to generation. Perhaps the most well known of all traditions is that of the Christmas tree. The act of putting it up and decorating it in one's home is a process that can be enjoyed by all members of the family. However, the physical size of most Christmas trees causes a number of aggravations. First, it is difficult to get the tree to be straight and plumb in the stand. Second, the tree stand takes an inordinate amount of space that takes away from space for presents and/or other holiday decorations. Third, it is difficult to clean or vacuum around. Finally, one must kneel down or bend over to water the tree, which is difficult to do on a daily basis. Accordingly, there is a need for a means by which Christmas trees can be supported in a manner that reduces or eliminates the aggravations as described above. The development of the present invention fulfills this need.

Several attempts have been made in the past to develop a combined tree supporting and watering stand for maintaining a tree at a vertical position while supplying a predetermined quantity of water to the tree. U.S. Pat. No. 5,575,110 in the name of Couture discloses a self-watering tree stand having an external reservoir for holding a supply of water and a tube leading from the reservoir to a compartment in the tree stand. The compartment has a float valve for controlling the amount of water which is allowed to flow from the reservoir to the tree stand, and also, has a screen, the upper portion is made from a solid material and the lower portion is made from a screen type mesh which prevents debris and tree pitch from entering the compartment and interfering with the float valve. Unfortunately, this prior art example does not allow for supporting a tree from the middle section, thereby freeing up a quantity of space below the tree.

U.S. Pat. No. 5,522,179 in the name of Hollis discloses an automatic water level control system, for use in conjunction with a Christmas tree stand of the type having a watering basin with an outer rim and a tree clamping mechanism for holding the Christmas tree in an upright manner with the base portion of the tree disposed within the watering basin. The water level control system includes a water supply container, a flexible conduit, an attachment mechanism, and a valve mechanism. The water supply container serves as a holding tank for water which is supplied to the watering basin of the Christmas tree stand via the flexible conduit. The water level in the watering basin is regulated by the valve mechanism attached to the Christmas tree stand. The attachment mechanism has a main body and is attachable to the outer rim of the watering basin in a manner to functionally secure the main body to the Christmas tree stand. The valve mechanism includes a watering port, a valve, and a float member. The watering port is in fluid communication with the second end of the flexible conduit member such that water flowing from the water supply container through the flexible conduit ultimately exits the watering port into the watering basin. Unfortunately, this prior art example does not provide a means of suspending a water supply container in conjunction with the tree stand.

U.S. Pat. No. 5,791,083 in the name of Giangrossi describes a device for monitoring and maintaining the water level in the reservoir of a Christmas tree stand having a filler portion communicating with a flexible filler conduit. A water level indicator, includes an indicator float which is slidably engaged within the indicator float housing and which travels freely along a substantially vertical axis within the indicator float housing, a flexible indicator stem is attached to the indicator float and extends up through a flexible conduit for indicating, by means of the relative extension of the flexible indicator stem, the water level in the tree stand reservoir. The indicator float housing is formed having a number of holes through its outer wall for the free passage of water in and out of the indicator float housing from the reservoir for buoyantly raising or lowering the indicator float, consistent with the level of water in the reservoir. Unfortunately, this prior art example requires a separate tree stand be used in conjunction with the device, as opposed to incorporating the watering means with the tree stand.

U.S. Pat. No. 5,446,993 in the name of Cullen discloses a watering system which permits the convenient watering of potted plants and trees, in particular, evergreen trees, i.e. Christmas trees, in tree stands. The watering system is a tubular device having one end enlarged to form a funnel-like receptacle to receive the water or other liquid which is delivered via the tubular device to the pot or stand through an exit port at the opposite end. The base of the watering system is upheld upright by a band hooked about a projection on the watering system which supports the system against the base of a plant or tree. Between the two ends of the watering system, there is a bend which causes the funnel-like receptacle to extend beyond or into the foliage providing easy access for watering. Decorating elements may be added to camouflage or add ornamentation as desired. The watering system may be divided into several segments for convenience of storage and/or manufacturer. Unfortunately, this system does not incorporate a tree stand with the watering means, and also does not provide a water supply container.

None of the prior art particularly describes a combined tree supporting and watering stand for maintaining a tree at a vertical position while supplying a predetermined quantity of water to the tree. Accordingly, there is a need for a system which provides such features while overcoming the above-noted shortcomings.

SUMMARY OF THE INVENTION

In view of the foregoing disadvantages inherent in the prior art, it has been observed that there is need for a combined tree supporting and watering stand for maintaining a tree at a vertical position while supplying a predetermined quantity of water to the tree.

The system includes a base removably positioned on a ground surface, a vertical member directly coupled to the base, without the use of intervening elements, and extending upwards therefrom, and a support member directly connected to the vertical member, without the use of intervening elements, and extending perpendicularly away therefrom. The support member is telescopically slidable along an extension member of the vertical member, which is important such that the support member is biased along a lateral direction. Of course, such members can be produced in a variety of sizes, as is obvious to a person of ordinary skill in the art.

The assembly further includes a power strip removably attached to the vertical member, which is essential for providing an electric power source to a plurality of decorative lights positioned on the tree.

The system further includes a mechanism for automatically watering a stalk of the tree during an extended period of time. Such an automatic watering mechanism is directly anchored to the support member, without the use of intervening elements. Such an automatic watering mechanism includes a water reservoir attached to the support member and suspended at an elevated height above the ground surface. A water receptacle is removably attached to the stalk of the tree and is in fluid communication with the reservoir. Of course, such a reservoir and receptacle can be produced in a variety of shapes and sizes, as is obvious to a person of ordinary skill in the art. A flexible tube has opposed ends directly mated to the reservoir and the receptacle, without the use of intervening elements, which is critical such that the tube selectively delivers water from the reservoir to the receptacle, which is advantageously located downstream of the reservoir. Of course, such a tube can be formed from a variety of suitable materials, as is obvious to a person of ordinary skill in the art.

The reservoir includes an unobstructive lid removably and snuggly fitted directly against an upper surface of the reservoir, without the use of intervening elements, which is essential for allowing necessary pressure equalization. The water receptacle is located subjacent to the water reservoir, which is critical for providing positive water pressure to the reservoir and thereby advantageously preventing the water from flowing upstream from the receptacle towards the reservoir.

The automatic watering system further includes a float valve operably attached to a distal end of the tube. Such a float valve has a float operably coupled thereto, which is crucial such that the float rises when a water level increases within the receptacle, and falls when the water level decreases within the receptacle. Such a float cooperates with the float valve in such a manner that the float valve advantageously opens and closes when the water level falls below and rises above a predetermined threshold respectively. Of course, such a float valve can be produced in a variety of shapes and sizes, as is obvious to a person of ordinary skill in the art.

The system further includes an extended arm that has opposed ends directly coupled to the float valve and the float respectively, without the use of intervening elements. Such an extended arm withholds a weight of the float and thereby advantageously absorbs a force due to buoyancy from the float for causing the extended arm to pitch. Upward movement of the float causes the extended arm to pitch upwardly, which is vital to close the float valve and to stop water, while downward movement of the float causes the extended arm to pitch downwardly, which is important to open the float valve and thereby permit water to flow into the receptacle.

The system further includes a mechanism for supporting the tree at an elevated vertical position above the ground surface. Such a tree supporting mechanism is advantageously anchored to the support member. The tree supporting mechanism includes a clamping mechanism monolithically formed with the support member. Such a clamping mechanism is adjustably and perpendicularly mounted to the vertical member via an extension member of the vertical member. Such a clamping mechanism is "U"-shaped and has a plurality of threaded bores formed therein.

A plurality of fasteners is threadably affixed with the bores respectively. Of course, such fasteners can be produced in a variety of shapes and sizes, as is obvious to a person of ordinary skill in the art. The clamp mechanism further includes a plurality of arcuate members adjustably coupled to the fasteners and directly abutted against the stalk of the tree, without the use of intervening elements. Each of such arcuate members includes a shaft rotatably connected directly to a corresponding one of the shafts, without the use of intervening elements. The fasteners define a plurality of sleeves, which is crucial for allowing the shafts to advantageously rotate about a lateral axis while the arcuate members remain disposed at a predetermined vertical height from the ground surface respectively.

The combination of a watering apparatus and a support mechanism in one system provides the unexpected benefit of allowing a user to both water and support a tree using only one associated group of elements within the one system, thereby overcoming prior art shortcomings.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
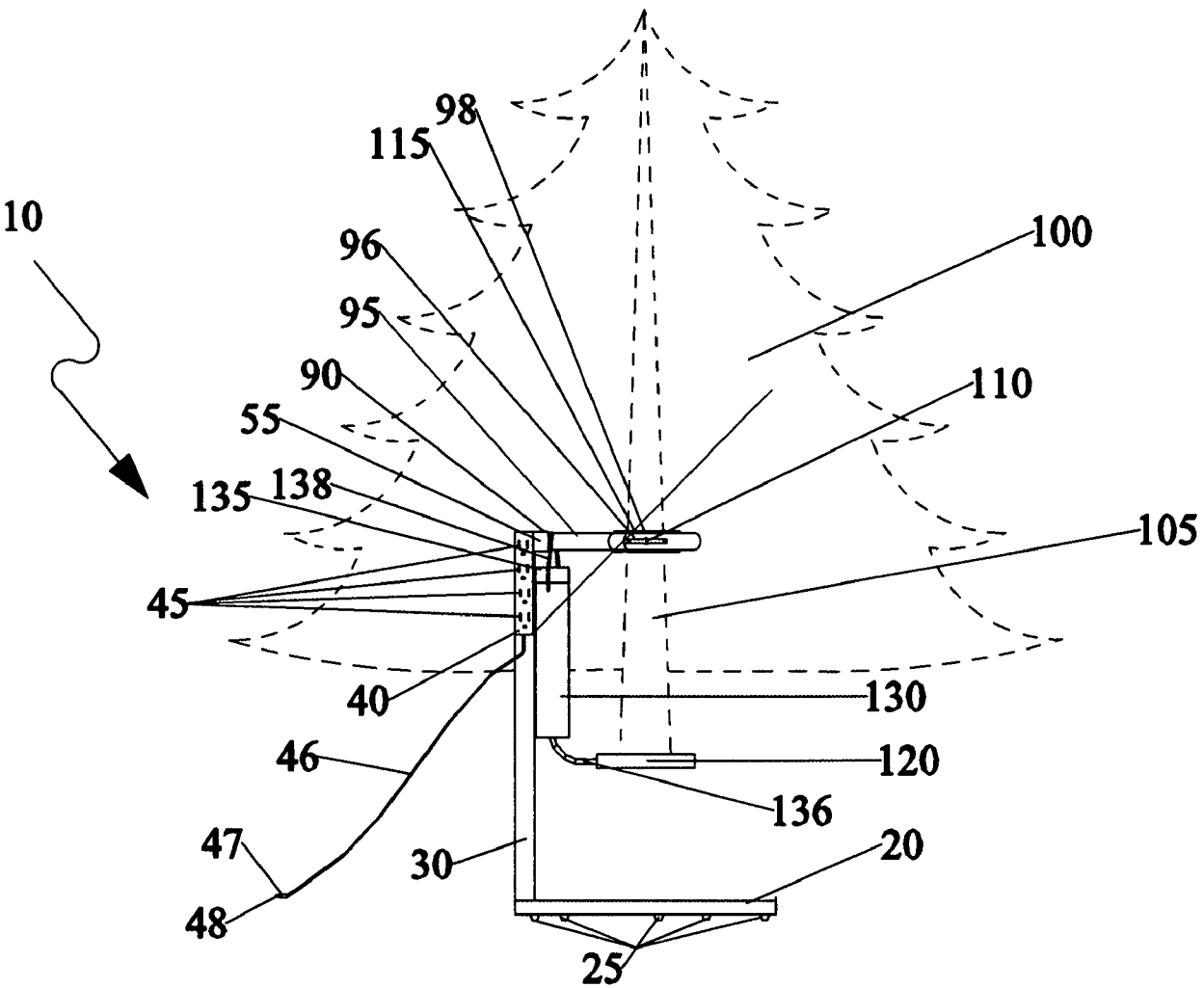
FIG. 1 is a side view of a self-watering vertically adjustable tree stand 10 securing a Christmas tree 100, according to the preferred embodiment of the present invention.

| | |
|---|---|
| 10 | self-watering vertically adjustable tree stand |
| 20 | base |
| 25 | rubber feet |
| 30 | vertical member |
| 40 | ground fault circuit interrupter power strip |
| 45 | female adapter |
| 46 | cord |
| 47 | plug |
| 48 | plug prongs |
| 55 | extension member |
| 56 | pin aperture |
| 57 | receiving aperture |
| 90 | projection pin |
| 95 | support member |
| 96 | clamping mechanism |
| 98 | washer |
| 99 | shaft |
| 100 | Christmas tree |
| 103 | bore |
| 105 | tree stalk |
| 110 | winged screw |
| 115 | rubber-coated member |
| 120 | water receptacle |
| 125 | float |
| 126 | screw |
| 130 | water reservoir |
| 135 | lid |
| 136 | tube |
| 137 | protrusion |
| 138 | chain |
| 140 | water |
| 145 | extended arm |
| 150 | float valve |

DETAILED DESCRIPTION OF THE PREFERRED EMBODIMENT

The best mode for carrying out the invention is presented in terms of its preferred embodiment, herein depicted within FIGS. 1 through 9. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes an apparatus and method that incorporates a self-watering, vertically adjustable tree stand. The self-watering vertically adjustable tree stand (herein described as the "apparatus") 10 comprises a base 20, a vertical member 30, a water receptacle 120, a clamping mechanism 96, a water reservoir 130, a ground fault circuit interrupter (GFCI) power strip 40, and a means for attachment of said components.

Figure 2:
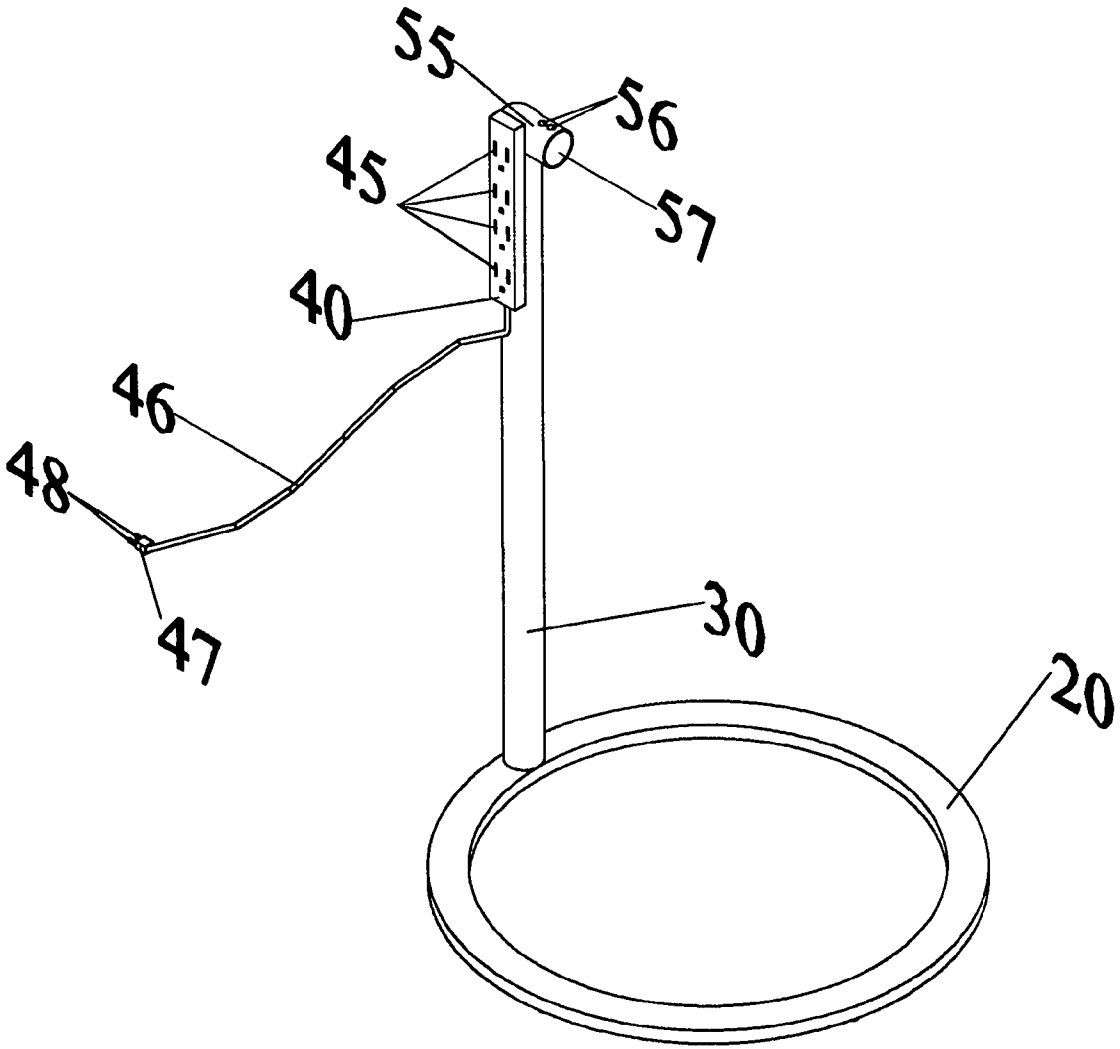
FIG. 2 is a perspective view of a base member 20 with a vertical member 30 embedded thereon having a ground fault circuit interrupter (GFCI) power strip 40 removably attached thereon, according to the preferred embodiment of the present invention.
Figure 3:
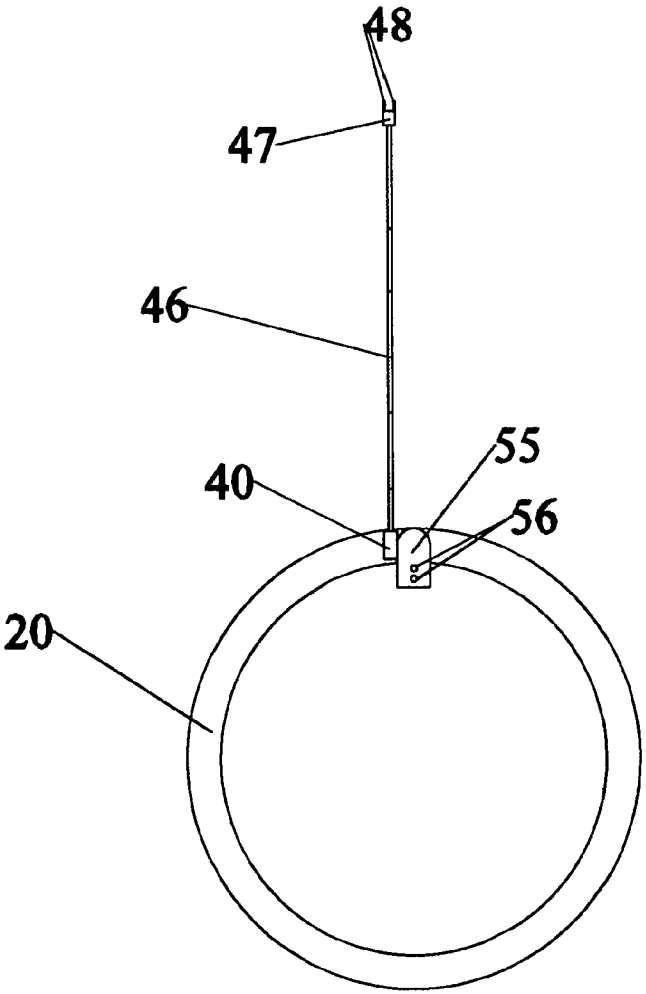
FIG. 3 is a top view of the base member 20 with the vertical member 30 removably attached thereon having the ground fault circuit interrupter (GFCI) power strip 40 removably attached thereon, according to the preferred embodiment of the present invention.

Referring now to FIGS. 1 through 3, pictorial representations of the apparatus 10 and a portion of the components according to the preferred embodiment of the present invention, is disclosed. A base member 20 of circular design is envisioned to support the apparatus 10 before, during, and after securing a Christmas tree 100. The base 20 comprises a circular framework having an overall diameter sizable to accommodate the weight of the apparatus 10 and the tree 100. The base 20 comprises a rectangular cross-section in a coplanar format with a reasonably dense thickness for optimum stability and strength capabilities. The bottom of the base 20 is envisioned to comprise a plurality of removably attachable rubber feet 25 for the minimization of damage done to rugs, hardwood floors, ceramic floors, or other floors. The feet 25 are envisioned to be fabricated of a hard rubber and may be attached thereto the bottom surface of the base 20 to protect the floor from scraping, scratching, rubbing, and the like against the desired floor surface while preventing sliding of the apparatus 10.

The base member 20 comprises a vertical member 30 removably attached thereto, envisioned to comprise a circular cross-sectional tubing, projecting vertically upwards at a designated distance. The vertical member 30 can be welded, bolted, or otherwise permanently fixed transversally thereto the axial plane of the base 20; however, it is preferred if the vertical member 30 to be temporally affixed thereto the base 20. The vertical member 30 comprises an upper end and a lower end thereof such that the lower end is detachably affixed thereto the base 20 thereof. The lower end is centrally positioned thereon the base 20 having the diameter preferably the same as the base 20 thickness for optimal stabilization. The upper end comprises an extension member 55 having a support aperture 57 receiving and accepting a support member 95 having a clamping mechanism 96 described in more detail subsequently.

A ground fault circuit interrupter (GFCI) power strip 40 is removably attached thereto the upper portion of the vertical member 30 to provide an electric power source to electrically power decorative lights and/or other ornamentation. The GFCI power strip 40 has a rectangular face comprising two (2) to four (4) openings or female adapters 45 embedded on the face in electrical communication with a power supply. The female adapter 45 is adapted to except and retain prongs 48 of an electric plug 47, from decorative lights for example, and maintain electrical continuity. The GFCI power strip 40 comprises a cord 46 with a plug 47 electrically connected at the distal end thereof. The GFCI power strip 40 operates from an AC or DC input voltage power source preferably having remote reset capability to provide protection for the power supply and against user injury. The cord 46 extends downwardly and may be affixed to the vertical member 30 via ties, binding, string, or other suitable means such to prevent entanglement of the cord 46.

Figure 4:
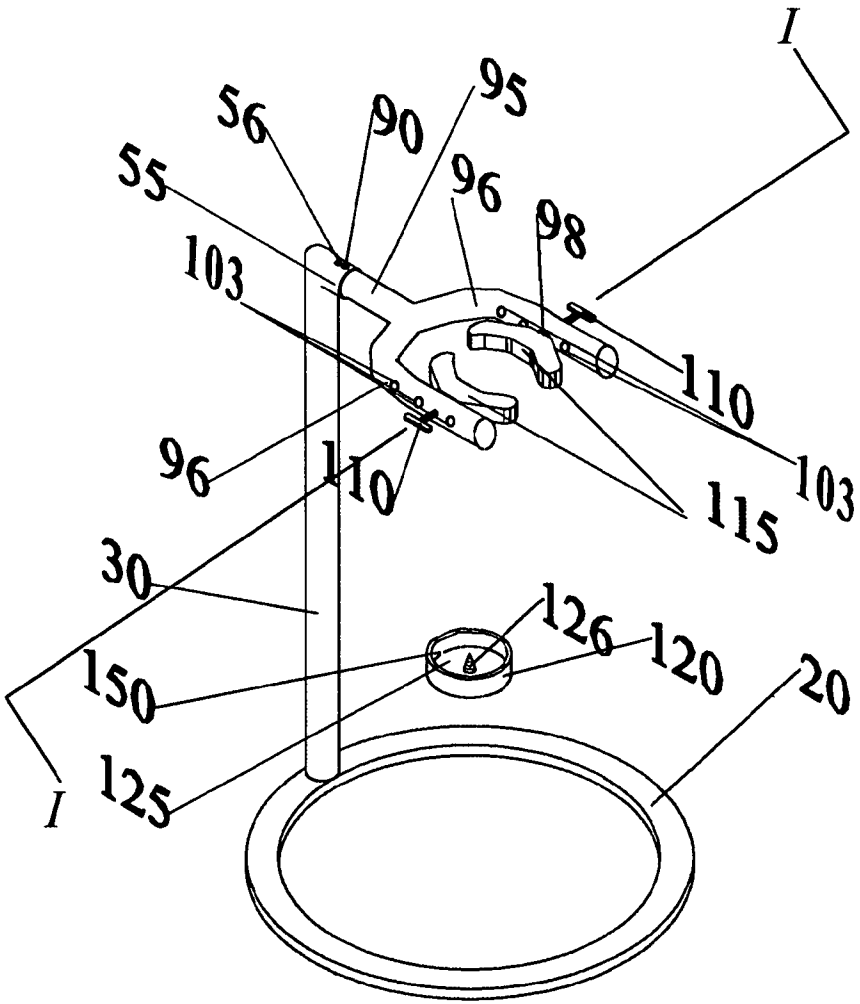
FIG. 4 is a perspective view of the base member 20 and the vertical member 30 with an adjustable clamping mechanism 96 and a pictorial representation of the placement of a water receptacle 120, according to the preferred embodiment of the present invention.
Figure 5:
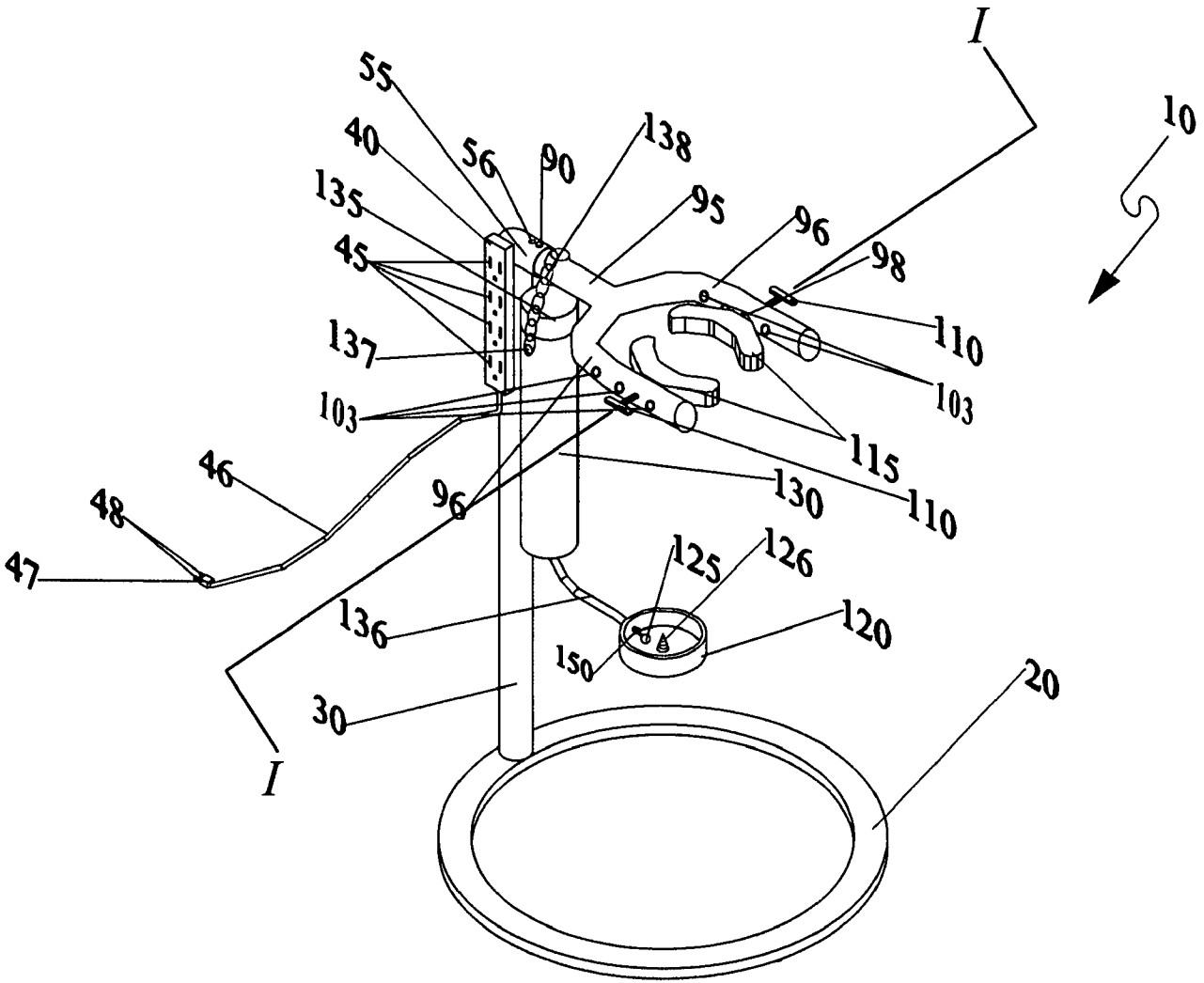
FIG. 5 is a perspective view of the self-watering vertically adjustable tree stand 10, according to the preferred embodiment of the present invention.
Figure 6:
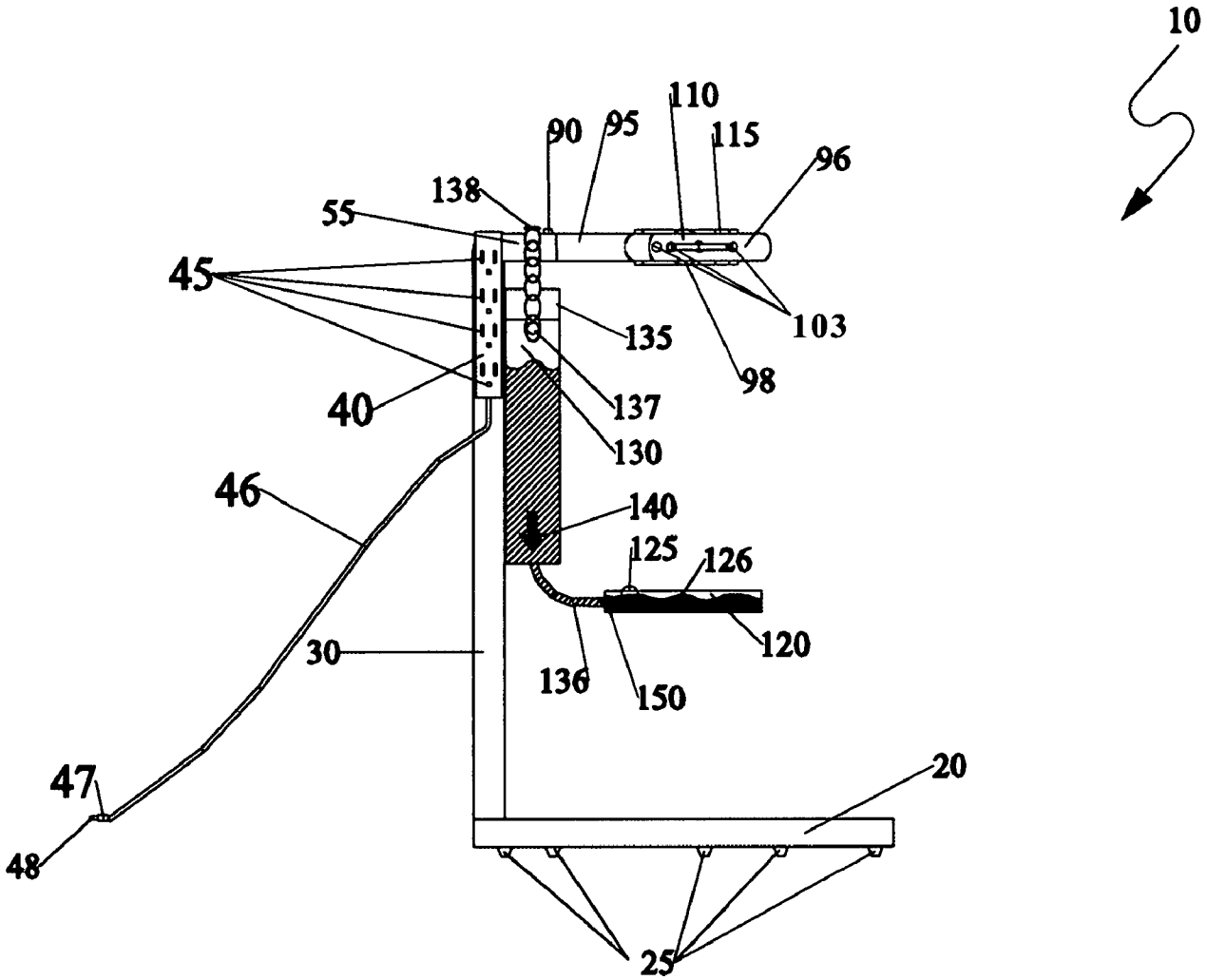
FIG. 6 is a side view of the self-watering vertically adjustable tree stand 10 with a transparent view of the water reservoir 130, channeling tube 136, and water receptacle 120, according to the preferred embodiment of the present invention.

Referring now to FIGS. 4 through 6, pictorial representations of the apparatus 10 and a portion of the components according to the preferred embodiment of the present invention, is disclosed. A water receptacle 120 is removably attached thereto a stalk 105 of a desired Christmas tree 100. The water receptacle 120, envisioned to be fabricated brass coupling, which is dense, corrosion resistant, inexpensive, and readily available, has a diameter considerably larger than that of a conventional tree 100 such to encircle the stalk 105 of said tree 100 while leaving sufficient space to contain water 140 and to allow a user put in additives such as vitamins, preservatives, and the like. The water receptacle 120 comprises a screw 126 or nail welded thereon the base surface of the receptacle 120. The receptacle 120 is designed as a one-piece component being leak-proof while keeping the minimum system water level 140 above the tree stalk 105 cut, insuring the tree stalk 105 is always in the water 140. The water level 140 will typically be approximately one (1) to three (3) inches from the base of the stalk 105 such that it will remain immersed for adequate consumption for a live tree 100. The removability features of the water receptacle 120 permit the occasional discarding of water 140 which may become dirty and somewhat stagnant.

The reservoir 130 is envisioned to be designed in a cylindrical format capable of holding a sufficient amount of water 140 to supply the water receptacle 120 with the necessary water 140. The reservoir 130 is designed to be leak-proof while being unobstructive having a lid 135 to fit snuggly thereon the upper surface without having a seal, allowing the necessary pressure equalization to occur. The lid 135 protects from outside substances (i.e. pine needles) undesirably from traveling within the reservoir 130 while preventing spillage of water 140 residing therewithin. The lid 135 could be screwed threaded or could be simply a friction fit on the reservoir 130.

The reservoir 130 will have a height sufficient to contain a water level 140 high enough to permit the flow of water 140 to the receptacle 120. The size of the reservoir 130 will vary depending on the size of the tree 100 to be withheld. The reservoir 130 is capable of containing a sufficient amount of water 140 while still delivering a certain amount of water 140 to the receptacle 120 until the receptacle 120 is containing a sufficient amount of water 140. The reservoir 130 is at a higher elevation therefrom the receptacle 120 thereby providing positive water 140 pressure thereto said reservoir 130 without the opportunity of the "old" water 140 in the receptacle 120 to flow backwardly and upwardly towards the reservoir 130 thereby providing clean water 140 therewithin. The receptacle 120 and/ reservoir 130 may be of plastic or glass such to contain transparent or translucent qualities so the amount of water 140 left residing therewithin may be easily discernible.

The base of the reservoir 130 comprises a fluid dispersing aperture (not pictured) to which the water 140 exits therethrough to a tube 136. A flexible tube 136 of certain diameter, preferably, but not essentially, one-fourth (¼) of an inch, delivers the water 140 from the reservoir 130 to the receptacle 120. The tube 136 comprises a fluid dispersing end which is in fluid communication with the receptacle 120 and a fluid receiving end which is in fluid communication with the fluid dispersing aperture of the reservoir 130. Both ends of the tubing 136, the fluid receiving end and the fluid dispersing end is connected and sealed to the fluid receiving aperture of the receptacle 120 and the fluid dispersing aperture of the reservoir 130. The tube 136 allows a continuously inter-connection of the reservoir 130 and receptacle 120 water-sealed thereby preventing leakage. The tube 136 may be transparent or translucent such to permit a user to observe that the reservoir 130 and the receptacle 120 are continuously inter-connected. The tube 136 is long enough to span across the reservoir 130 thereto the receptacle 120 with ample excess remaining should additional tubing 136 be needed.

The reservoir 130 is secured thereon a support member 95 via a strapping mechanism preferably a chain 138 having links, as depicted in the figures. The strapping mechanism may be any other device suitable to secure and withstand the weight of the reservoir 130 and the water 140 residing therewithin. Protruding members 137 allow the points of connection of the chain 138. The chain 138 is attached on two (2) sides of the outer diameter of the reservoir 130 preferably 180° apart thereof. The upward tension on the chain 138, exerted by the weight of the reservoir 130 and water 140 stabilizes the chain 138 tightly against the support member 95 which allows the chain 138 to support the weight of the reservoir 130 and water 140. The reservoir 130 may comprise a handle (not pictured) thereupon the surface so it can be easily moved and/or refilled.

Figure 7B:
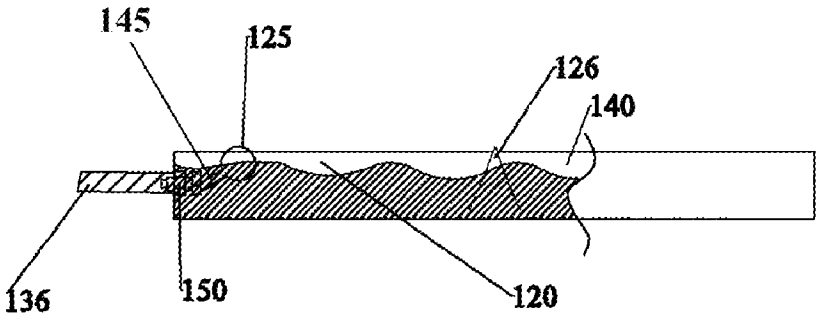
FIG. 7*b* is a transparent side view of the water receptacle 120 and a float valve 150 having a float 125 with water 140 residing in said water receptacle 120, according to the preferred embodiment of the present invention.
Figure 7A:
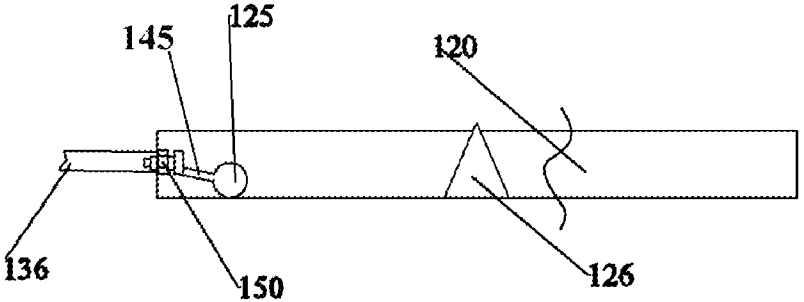
FIG. 7*a* is a transparent side view of the water receptacle 120 and a float valve 150 having a float 125 with no water 140 residing in said water receptacle 120, according to the preferred embodiment of the present invention.

Referring now to FIGS. 7*a* and 7*b*, transparent side views of the water receptacle 120 and a float valve 150 having a float 125 according to the preferred embodiment of the present invention, is disclosed. The receptacle 120 comprises a float valve 150 utilized as a mechanical electrical which operates having a float 125 to raise when the water level 140 goes up, as depicted in FIG. 7*b*, and drop when the water level 140 goes down, as depicted in FIG. 7*a*, with respect to a specified level. The float valve 150 is a mechanical feedback mechanism in fluid communication with the fluid receiving aperture of the tube 136 to regulate the water level 140 therewithin the receptacle 120 via a float 125 to drive an inlet valve such that a higher water level 140 will force the valve 150 closed whilst a lower water level 140 will force the valve 150 open. Thus, the float valve 150 will allow a predetermined level of water 140 to enter the receptacle 120, thereby shutting off the water supply 140, the water reservoir 130. The float 125, fabricated of a buoyant material, is free to move up and down according to the level of water 140 and is mounted thereupon an extended shaft arm 145 at the distant end.

The extended arm 145 withholds the weight of the float 125 thereby absorbing the force due to buoyancy from the float 125 and causing the extended arm 145 to pitch. Upward movement of the float 125 causes the extended arm 145 to pitch upwardly to close the float valve 150 and to stop the flow of water 140, while downward movement of the float 125 causes the extended arm 145 to pitch downwardly to open the float valve 150 and to permit the flow of water 140 therein.

It will be appreciated to those skilled in the art that other float valve 150 designs may also be used in accordance with the invention to permit the automatic control of water flow 140 without intervening with the scope of the invention.

Figure 8:
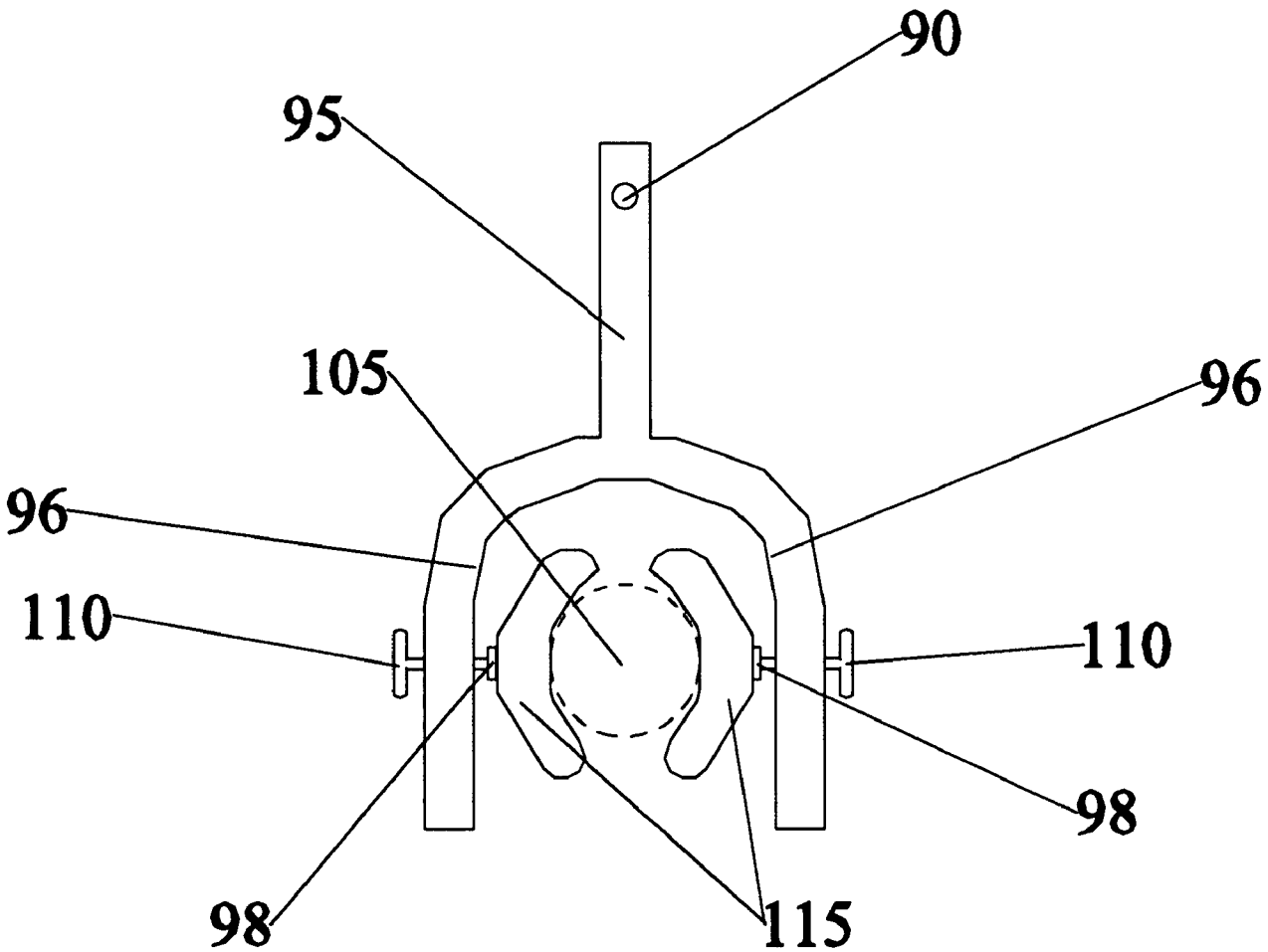
FIG. 8 is a top close-up view of the clamping mechanism 96 securing cross-section of a tree stalk 105 thereof, according to the preferred embodiment of the present invention; and, FIG. 9 is a side view of a rubber-coated member 115 and the insertion thereinto a winged screw 110, according to the preferred embodiment of the present invention.

Referring now to FIG. 8, a top close-up view of the clamping mechanism 96 securing a tree stalk 105 thereof according to the preferred embodiment of the present invention, is disclosed. A support member 95 is adjustably and perpendicularly mounted to the vertical member 30 via an extension member 55 permanently and perpendicularly integrated thereon the uppermost portion of said vertical member 30. The vertical member 30 may bend perpendicularly such to provide the extension member 55 or the extension member 55 may be later installed thereupon the vertical member 30 at the uppermost edge.

The support member 95 is provided to provide support for the Christmas tree 100 and help maintain the upright position of the tree 100. The extension member 55 is envisioned to have an opened end 57 such to slidably receive the support member 95. The extension member 55 and the support member 95 are envisioned to comprise a circular cross-section, preferably tubular having the extension member 55 with a larger diameter than the support member 95 such that the inner diameter of said extension member 55 is similar or slightly larger than the outer diameter of said support member 95.

The support member 95 has a first and second end comprising a circular cross-section, preferably tubular shaped to correspondingly be inserted therewithin the extension member 55 such that the inside walls of the extension member 55 uniformly abuts against the outside walls of the support member 95. The support member 95 is sized to slidably move in a lateral direction within the extension member 55. The extension 55 and support 95 members each have a contact surface having a plurality of apertures 56 equally spaced therethrough said surface. The apertures 56 are drilled therethrough the extension member 55 for selectively receiving a projection pin 90 to secure the relative position of the support member 95. The apertures 56 are selectively alignable with the projection pen, and then fastenable with said projection pin 90.

Figure 9:
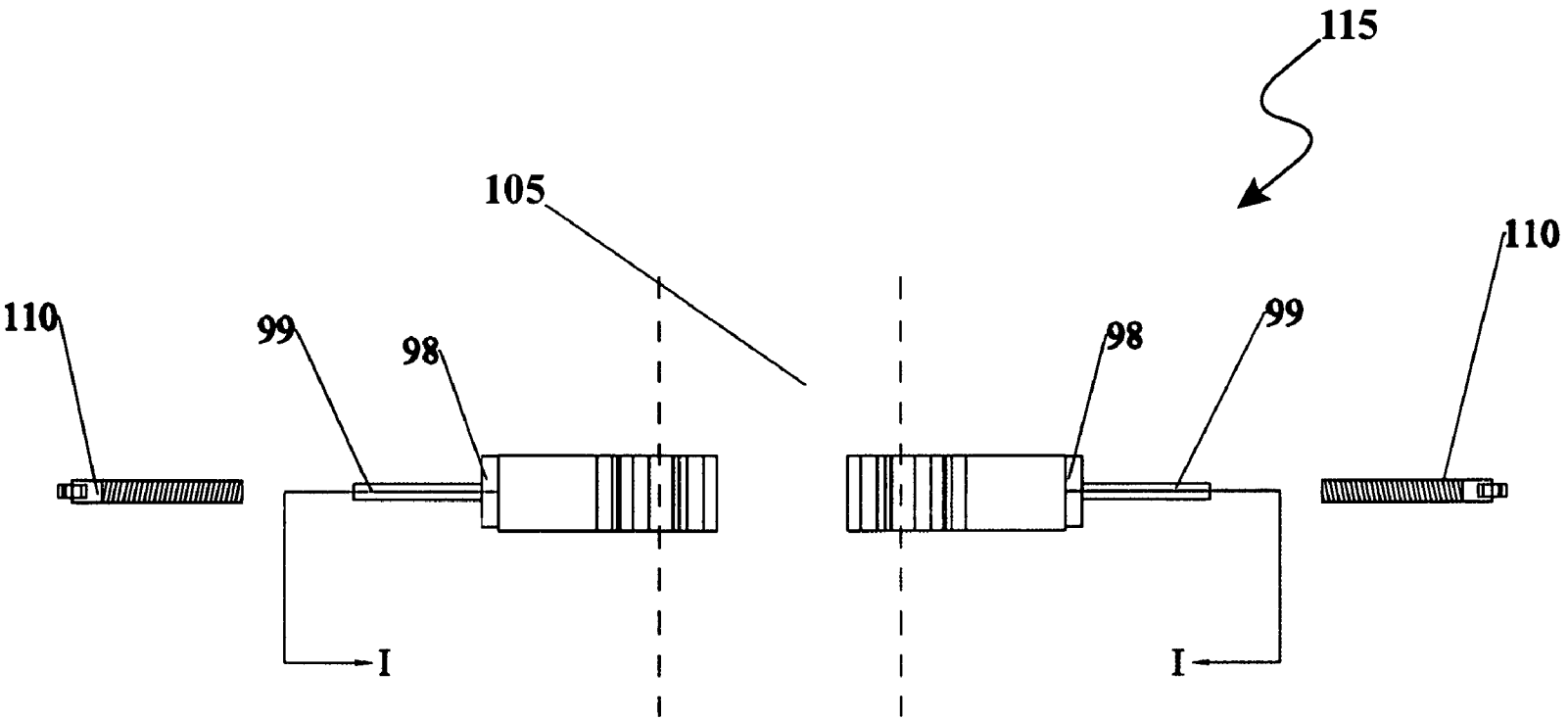

Referring now to FIG. 9, a side view of the rubber-coated member 115 and the insertion thereinto a winged screw 110 according to the preferred embodiment of the present invention, is disclosed. The support member 95 comprises a clamping mechanism 96 for the proper secure the placement of the stalk 105 of a tree 100 in an upright position perpendicularly with respect to the ground or other horizontal surface. The clamping mechanism 96 is envisioned to be "U" shaped with a plurality of bores 103 with threads incorporated therewithin each to operably engage and receive a threaded screw 110.

The two (2) threaded winged screws 110 are utilized to secure the stalk 105 of the tree 100 within said clamping mechanism 96. The threaded screws 110 comprise a rubber-coated member 115 incorporated at the distal end shaped much like a "U". The rubber-coated member 115 is slightly contoured and rounded to abut thereagainst the stalk 105 of the tree 100. The rubber-coated member 115 is envisioned to comprise a shaft 99 to be operably received therewithin a bore or the like (not pictured) centered in the winged screws 110 with a washer 98 abutting thereagainst the rubber member 115.

The winged screw 110 acts like a sleeve or the like to allow rotatable motion of the rubber-coated member 115 and/or shaft 99 about the lateral axis I-I, without the longitudinal movement of said rubber-coated member 115 and shaft 99, as depicted in FIG. 9. The rubber-coated members 115 are designed specifically to completely or partially encircle the stalk 105 of the tree 100 above the central point of the base 20 thereby securing the tree 100 with a center of gravity on or in close proximity to the center of the base 20 thereby providing optimum stability. The rubber-coated members 115 have an adjustable opening for receiving and securing the stalk 105 of the tree 100. Said opening may be expanded by the utilization of the two (2) winged screws 110 mirrored equidistantly therefrom the axis of the support member 95. The winged screws 110 bring the rubber-coated members 115 closer together for trees 100 whose stalks 105 comprise a relatively small diameter. On the contrary, the opposite applies for those stalks 105 which comprise a relatively large diameter, to which case, the screws 110 may bring the rubber-coated members 115 outwardly further apart thereby providing a wide range of opening space for larger and/or unsymmetrical stalks 105.

The threaded screws 110 are inserted therewithin the clamping mechanism 96 comprising two (2) apertures defining bores for rotatably accepting said screws 110 so that the rubber coated member 115 may be abutting thereagainst the stalk 105 of the tree 100 in order for securely holding said tree 100. The rubber-coated members 115 are envisioned to conform thereto the outer periphery of the stalk 105 of the tree 100 without puncturing said stalk 105. The rubber material provides a frictional force against the stalk 105 for optimum holding stability capabilities. Further, the rubber-coated member 115 is envisioned to be rotatable and/or pivotable along the lateral axis, I, of the threaded screws 110, as depicted in FIG. 9, to provide adjustments as needed. The rotatable and/or pivotable rubber-coated member 115 allows said member 115 to adjust accordingly thereby providing a wide range of securing features for trees 100 comprising symmetrical or unsymmetrical stalks 105. Alternate fastening mechanisms may be used.

An alternate embodiment of the present invention 10 may disclose alternate fixing means for the support member 95 to be adjustably slidably received therewithin the extension member 55. The extension 55 and support 95 members may each have a contact surface having a plurality of matching and transverse apertures 56 equally spaced therethrough two (2) surfaces spaced 180 therefrom each other such to receive a through pin 90. The transverse apertures of the support member 95 correspondingly match with the matching apertures 56 of the extension member 55 which may be selectively aligned and secured with the through pin to fix the relative position of the support member 95. The through pin will be inserted therethrough the matching aperture 56 on the upper surface of the extension member 55, therethrough the transverse aperture on the upper surface of the support member 95, therethrough the transverse aperture on the lower surface of the support member 95, and therethrough the matching aperture on the lower surface of the extension member 55. Yet further, the present invention 10 may disclose a supporting member 95 that comprises a pivot point with a position pin inserted through one of the pivot position holes. Thus the support arm 95 may pivot sideways, downwardly, and/or upwardly.

Another alternate embodiment of the present invention 10 may disclose an adjustable vertical member 30 of telescoping construction so that the apparatus 10 may be adjusted in height. The vertical member 30 may be designed in sections such that each section is slightly smaller than the next such that the sections may be slid within one another so that the overall height of the apparatus 10 may be varied. Alternately, the vertical member 30 may contain apertures 56 for receiving a projection pin 90 or a through pin similar to the method used for the adjustable attachment of the extension member 55 and support member assembly 95 aforementioned.

Yet another alternate embodiment of the present invention 10 may disclose a decorative design with the colors symbolizing the time of the season with or without decorative motifs thereupon.

Still yet another alternate embodiment of the present invention 10 may disclose a support arm or the like integrally connected thereto the water receptacle 120 for further stabilization of the tree 100. Said support arm may comprise adjustment means such that it may adjustably and slidably move upwardly and downwardly along the vertical member 30 and releasably secured in a desired position thereon said vertical member 30 utilizing a clamping mechanism or the like.

Yet still another alternate embodiment of the present invention 10 may utilize a float switch having a float 125 connected to an extended shaft of a determined weight. Once the water level 140 reaches a certain height, the float 125 and the extended shaft closes a circuit which either closes a valve. This may be done with a ball valve with an electromechanical actuator to effect a positive shut-off when the water 140 reaches a certain height; however, other valves or a solenoid may be utilized. The float switch would sense the level of water 140 within the receptacle 120 to activate a valve producing discrete outputs as the water 140 reaches many different levels within the receptacle 120 and actuates a microswitch designed to be actuated by the physical motion of a mechanical device.

The preferred embodiment of the present invention can be utilized by the common user in a simple and effortless manner with little or no training. After initial purchase or acquisition of the self-watering, vertically adjustable tree stand 10, it would be configured as indicated in FIGS. 1 through 9.

The method of utilizing the device may be achieved by performing the following steps: securing the rubber feet 25 thereon the underside surface of the circular base 20 via screws, bolts, nuts, or other fastening means; securing the vertical member 30 perpendicularly thereon the base 20 with an extension member 55 protruding in a parallel arrangement therewith the floor; filling the water reservoir 130 therewith water 140 with or without additives therein; closing the lid 135 thereon the water reservoir 130; slidably attaching the support member 95 therein the extension member 55 until a designated position is achieved and locked via a projection pin 90 therethrough an aperture 56; attaching the reservoir 130 thereto the support member 95 via a chain 138 or other attachment means; fluidly attaching the float valve 150 and float 125 thereto the fluid receiving end of the receptacle 120; rotatably screwing the water receptacle 120 thereon the stalk 105 via a welded screw 126 positioned at the base of said receptacle 120; inserting the tree stalk 105 therein the clamping mechanism 96; securing said tree stalk 105 via rotatably screwing the screws 110 until the contoured rubber-coated members 115 are abutted thereagainst said tree stalk 105; fluidly attaching the tube 136 thereto the water reservoir 130 and/or water receptacle 120, if needed; and, utilizing the GFCI power strip 40 to power the holiday decor.

The apparatus 10 is envisioned to come in a variety of sizes and utilized to securely hold a Christmas tree 100 at various specified distances from the floor later to be determined to allow a storage area for gifts and/or decorations under the tree 100. The components of the apparatus 10 provide minimum storage space with the support member 95, vertical member 30, water receptacle 120, and the water reservoir 130 being unattachably secured. The apparatus 10 or portions of the apparatus 10 may be decorative to resemble the holidays. The apparatus 10 may further disclose the securement and watering of other trees 100 not prone to the holidays. The apparatus 10 may be used to water other plants and/or animals. Because the water receptacle 120 and water reservoir 130 are envisioned to fabricated of plastic, they can be colorful and decorative being transparent, translucent, or opaque. The water receptacle 120 receives water 140 therefrom a water reservoir 130. The water level 140 can likewise be checked either by lifting the lid 135 of the reservoir 130, if not of transparent or translucent qualities, observing the water flow 140 therethrough the tube 136, and/or observing the water receptacle 120, if needed. The water level 140 is specifically maintained via a horizontal float valve 150.

The reservoir 130 is located at an easily accessible point away from the tree 100. The vertical member 30 is positioned at a reasonable distance away from the tree 100 such to prevent obstruction to the tree 100 and/or the decorations laid upon the tree 100.

The water 140 flows from the reservoir 130 into the receptacle 120 via a tube 136. As the water level 140 in the receptacle 120 rises, the buoyancy causes the float 125 to rise. The buoyancy exerted by the float 125 is reflected upon the extended arm 145 to which closes and seals the float valve 150. As the water level 140 lowers in the receptacle 120 due to evaporation and absorption, the float 125 lowers accordingly eventually resulting in a buoyancy force no longer acting upon the float 125 and the extended arm 145 respectfully. The valve 150 is then opened to allow water 140 to flow from the reservoir 130 to the receptacle 120. This cycle is repeated continuously and automatically until the apparatus 10 is not longer of use for the holidays.

As a result of evaporation and the absorption of water by the tree 100, the water level 140 in the water receptacle 120 lowers. Float 125 lowers accordingly. With the force due to buoyancy of float 125 no longer acting upon the extended arm 145, the float valve 150 opens. Water 140 again flows from the water reservoir 130, through the tube 130, and into the water receptacle 120, and the cycle is repeated.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A combined tree supporting and watering stand for maintaining a tree at a vertical position while supplying a predetermined quantity of water to the tree, said combined tree supporting and watering stand comprising:

a base removably positioned on a ground surface;

a vertical member directly coupled to said base and extending upwards therefrom;

a support member directly connected to said vertical member and extending perpendicularly away therefrom;

a power strip removably attached to said vertical member for providing an electric power source to a plurality of decorative lights positioned on the tree;

means for automatically watering a stalk of the tree during an extended period of time, said automatic watering means being suspended from said support member; and, means for supporting the tree at an elevated vertical position above the ground surface, said tree supporting means being anchored to said support member;

wherein said automatic watering means comprises:

a water reservoir attached to said support member and further being suspended at an elevated height above the ground surface;

a water receptacle removably attached to the stalk of the tree, said receptacle being in fluid communication with said reservoir;

a flexible tube having opposed ends directly mated to said reservoir and said receptacle such that said tube selectively delivers water from said reservoir to said receptacle, said receptacle being locate downstream of said reservoir; and, said receptacle including a float valve operably attached to a distal end of said tube, said float valve having a float operably coupled thereto wherein said float rises when a water level increases within said receptacle, said float falling when the water level decreases within said receptacle, said float cooperating with said float valve in such a manner that said float valve opens and closes when the water level falls below and rises above a predetermined threshold respectively; and, wherein said receptacle is suspended in mid-air and thereby spaced above said base while remaining vertically aligned subjacent to said tree supporting means.

2. The combined tree supporting and watering stand of claim 1, further comprising: an extended arm having opposed ends directly coupled to said float valve and said float respectively, said extended arm withholding a weight of said float and thereby absorbing a force due to buoyancy from said float for causing said extended arm to pitch, wherein upward movement of said float causes said extended arm to pitch upwardly to close said float valve and to stop water while downward movement of said float causes said extended arm to pitch downwardly to open said float valve and thereby permit water to flow into said receptacle.

3. The combined tree supporting and watering stand of claim 1, wherein said reservoir includes an unobstructive lid removably and snuggly fitted directly against an upper surface of said reservoir for allowing necessary pressure equalization, said water receptacle being located subjacent to said water reservoir for providing positive water pressure to said reservoir and thereby preventing the water from flowing upstream from said receptacle towards said reservoir.

4. The combined tree supporting and watering stand of claim 1, wherein said tree supporting means comprises:

a clamping mechanism monolithically formed with said support member, said clamping mechanism being adjustably and perpendicularly mounted to said vertical member via an extension member of said vertical member, said clamping mechanism being U-shaped and having a plurality of threaded bores formed therein, said clamping mechanism further including a plurality of fasteners threadably affixed with said bores respectively, said clamping mechanism further including a plurality of arcuate members adjustably coupled to said fasteners and directly abutted against the stalk of the tree, each of said arcuate members including a shaft rotatably connected directly to a corresponding one of said plurality of fasteners.

5. The combined tree supporting and watering stand of claim 4, wherein said fasteners define a plurality of sleeves for allowing each of said shaft of said arcuate members to rotate about a lateral axis while said arcuate members remain disposed at a predetermined vertical height from the ground surface respectively.

6. The combined tree supporting and watering stand of claim 1, wherein said support member is telescopically slidable along an extension member of said vertical member such that said support member is biased along a lateral direction.

7. The combined tree supporting and watering stand of claim 4, wherein each of said arcuate members comprises a rubber coating.

8. The combined tree supporting and watering stand of claim 5, wherein each of said arcuate members comprises a rubber coating.

* * * * *